US010420996B2

(12) United States Patent
Paesang et al.

(10) Patent No.: US 10,420,996 B2
(45) Date of Patent: Sep. 24, 2019

(54) PROTECTIVE TRAVEL GOLF BAG

(71) Applicant: DICK'S SPORTING GOODS, INC., Coraopolis, PA (US)

(72) Inventors: Chinawut Paul Paesang, Beaver, PA (US); Richard Ray North, Pittsburgh, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 110 days.

(21) Appl. No.: 15/461,444

(22) Filed: Mar. 16, 2017

(65) Prior Publication Data

US 2017/0266520 A1 Sep. 21, 2017

Related U.S. Application Data

(60) Provisional application No. 62/422,322, filed on Nov. 15, 2016, provisional application No. 62/343,499, filed on May 31, 2016, provisional application No. 62/309,125, filed on Mar. 16, 2016.

(51) Int. Cl.
*A63B 55/00* (2015.01)
*A63B 55/40* (2015.01)

(52) U.S. Cl.
CPC ..... *A63B 55/406* (2015.10); *A63B 55/40* (2015.10); *A63B 2210/50* (2013.01)

(58) Field of Classification Search
CPC ..... A63B 55/005; A63B 55/00; A63B 55/004; A63B 55/007; A63B 55/008
USPC ..... 206/315.1, 315.2, 315.3, 315.4
See application file for complete search history.

(56) References Cited

U.S. PATENT DOCUMENTS

| | | | | |
|---|---|---|---|---|
| 4,512,465 | A | 4/1985 | Jobe | |
| 5,620,034 | A | 4/1997 | Flis | |
| 5,738,208 | A | 4/1998 | Roubal | |
| 6,371,291 | B1 * | 4/2002 | Laffy | A63B 55/00 206/315.4 |
| 2002/0113385 | A1 * | 8/2002 | Kang | B62B 1/045 280/47.18 |
| 2005/0029762 | A1 | 2/2005 | Chen | |

(Continued)

FOREIGN PATENT DOCUMENTS

CN 203060727 U 7/2013

OTHER PUBLICATIONS

ISA/US, International Search Report and Written Opinion issued on PCT application No. US17/22845, dated Jun. 12, 2017, 9 pages.

*Primary Examiner* — Fenn C Mathew
*Assistant Examiner* — Cynthia F Collado
(74) *Attorney, Agent, or Firm* — Fox Rothschild LLP

(57) ABSTRACT

A protective golf bag system includes a golf bag a removable protective cover. The cover is supported by a protector fitted into a top opening of the bag. The protector includes a divider with a plurality of arms spanning across the sides of the bag and adapted to attach to the sides. These arms form areas for inserting of a number of golf clubs. At the bottom of the bag is a plate to which is releasably anchored an extensible tube with a top portion and a bottom portion centrally positioned in the golf bag with a handle extending through a center of the divider. A button on the handle releases a connecting member at each of the top and bottom of the extensible tube that fixes the relative position of the top and bottom portions of the extensible tube.

12 Claims, 14 Drawing Sheets

(56) References Cited

U.S. PATENT DOCUMENTS

| | | | |
|---|---|---|---|
| 2006/0175782 | A1 | 8/2006 | Shin et al. |
| 2008/0169211 | A1 | 7/2008 | Franz |

* cited by examiner

PROTECTIVE TRAVEL GOLF BAG

CROSS REFERENCE TO RELATED APPLICATIONS

This application claims priority to U.S. Provisional Patent Application No. 62/422,322, filed Nov. 15, 2016, U.S. Provisional Patent Application No. 62/343,499, filed May 31, 2016, and U.S. Provisional Patent Application No. 62/309,125, filed Mar. 16, 2016 the disclosures of which are incorporated herein by reference in their entireties.

FIELD OF THE DISCLOSURE

The present description relates generally to protective golf bags and more particularly to a protective travel golf bag.

BACKGROUND OF RELATED ART

When not in use, golf clubs are typically protected by head mittens and/or by a flexible hood fitted over the heads of the clubs and releasably secured to the upper collar of the golf bag. While these measures provide basic protection, they do not necessarily provide significant protection against damage due to rough handling during long term storage and/or transport, such as for instance during air travel.

To provide additional protection, hard-sided travel bags are available to enclose and protect the traditional bags and clubs. While rigid structures are generally effective in combatting club damage they are typically larger, heavier, and/or more cumbersome than traditional golf bags and may require additional logistics handling, and shipment as well as storage of the hard-sided bag itself.

In an attempt to avoid a separate hard-sided shell, various devices to reinforce a typical soft-sided bag have been utilized as well. For example, U.S. Pat. No. 5,738,208 describes a golf bag that purports to protect golf clubs from damage during transit or storage. The golf bag includes a head member having a solid plate configuration and having a semi-rigid construction and an extensible rod assembly adapted to be positioned in the golf bag with the lower end of the rod assembly positioned on the base of the golf bag. The head member may be releasably attached to the upper end of the rod assembly or may be stored in a side pocket of the golf bag. The rod assembly is selectively moveable between an extended travel configuration having a length greater than the length of the longest club of the set of clubs, whereby the head member may be releasably attached to the upper end of the rod assembly so as to protectively overlie the head of the longest club to provide protection for the clubs in travel scenarios, and a retracted play configuration having a length less than the length of the golf bag, whereby the head member may be removed from the rod assembly and stored in the side pocket of the golf bag so that the rod assembly may reside unobtrusively in the bag during golf play.

DETAILED DESCRIPTION

Figure 2:
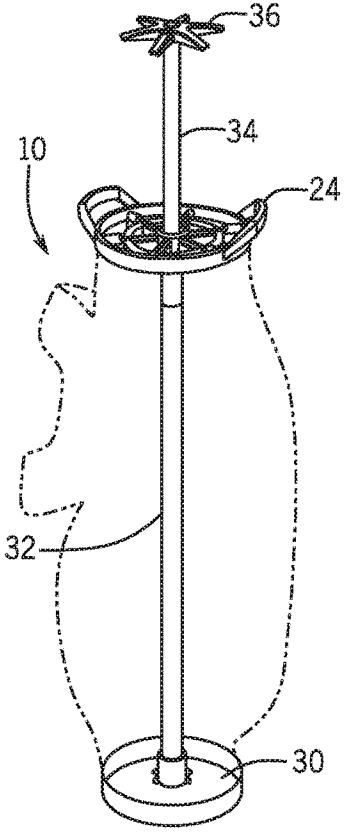
FIG. 2 is a side elevational view of the example protector.

The following description of example methods and apparatus is not intended to limit the scope of the description to the precise form or forms detailed herein. Instead the following description is intended to be illustrative so that others may follow its teachings.

Referring now to FIGS. 1-16, an example golf bag 10 comprising an example protector 20 is illustrated. In this example, the example protector 20 is suited for providing additional protection to the golf bag 10 and/or any golf clubs 22 housed therein as per normal usage. As will be appreciated by one of ordinary skill in the art, the golf bag 10 includes a collar 24 comprising at least one divider 26 and/or at least one handle 28. As will be appreciated, the divider(s) 26 provides for various compartments for the gold clubs 22 to be inserted into the bag 10, while the handle(s) 28 provide for a convenient mechanism by which a user may carry the bag 10.

Figure 6:
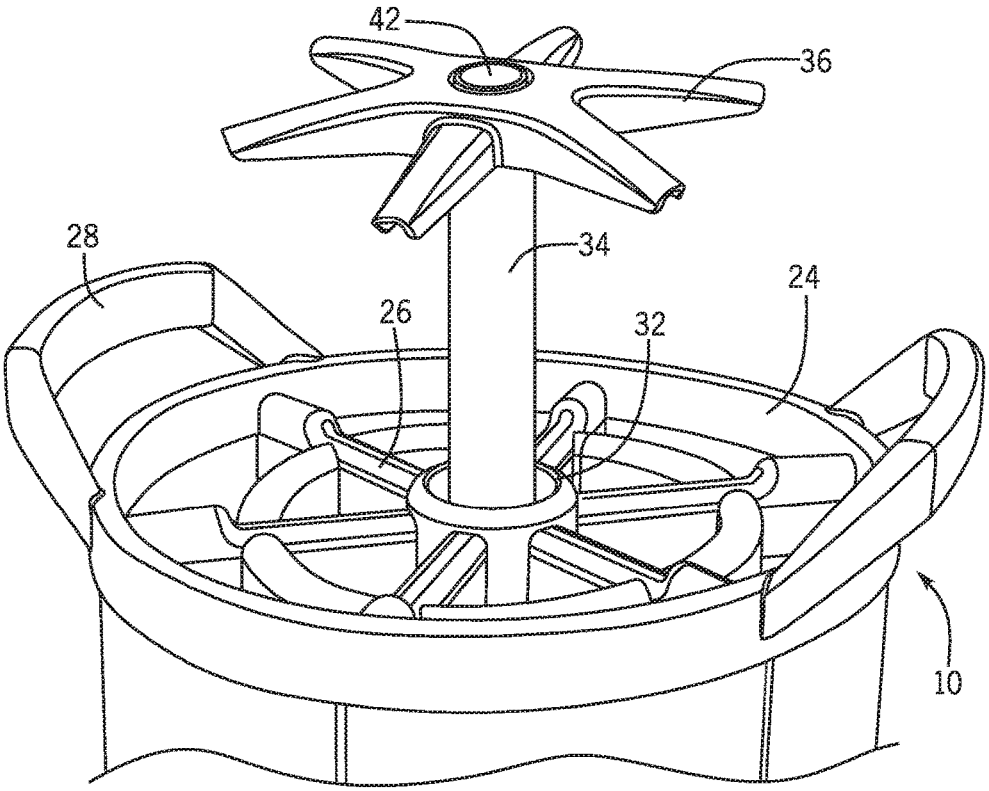
FIG. 6 is a partial perspective view of an example golf bag and protector in combination with the protector in an extended position.
Figure 7:
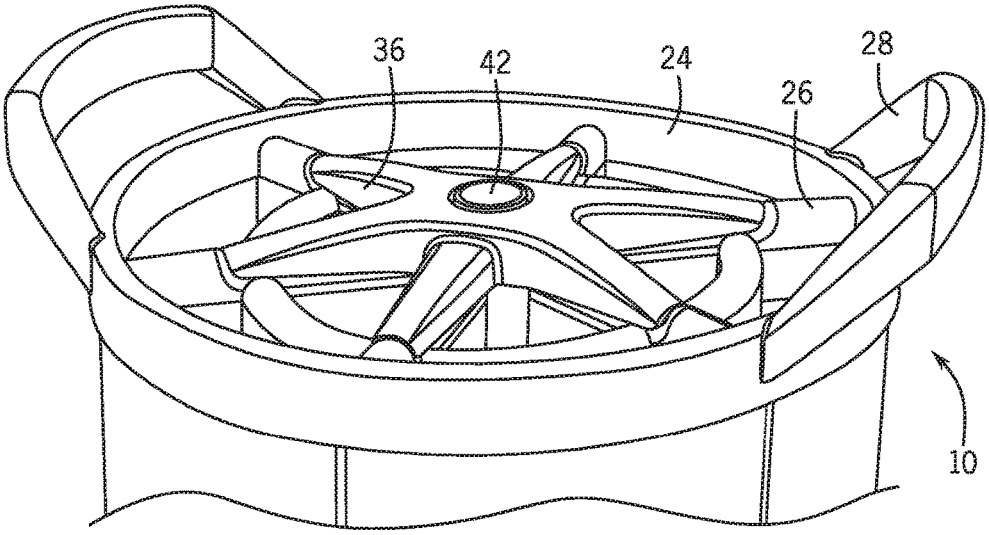
FIG. 7 is a partial perspective view of an example golf bag and protector in combination with the protector in a retracted position.
Figure 8:
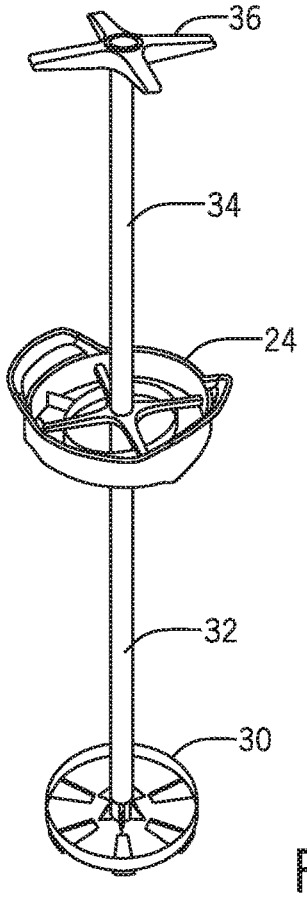
FIG. 8 is another perspective view of the example protector.
Figure 9:
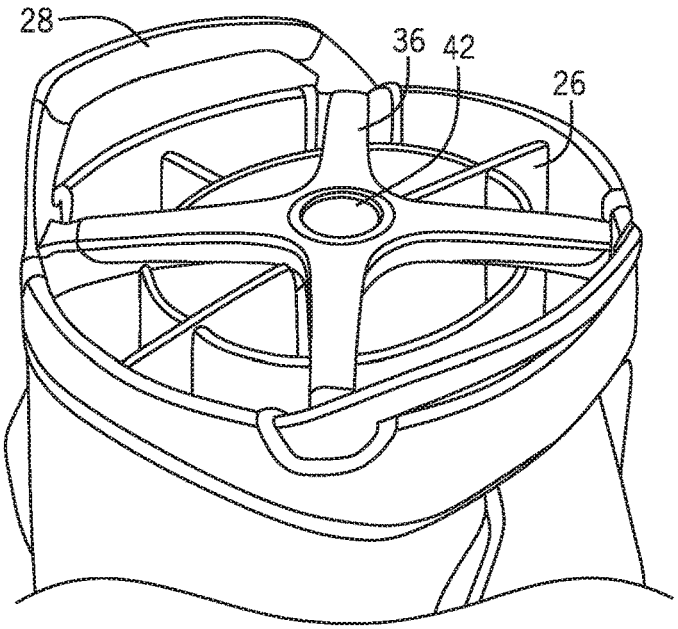
FIG. 9 is another partial perspective view of the example golf bag and protector in combination with the protector in the retracted position.
Figure 11:
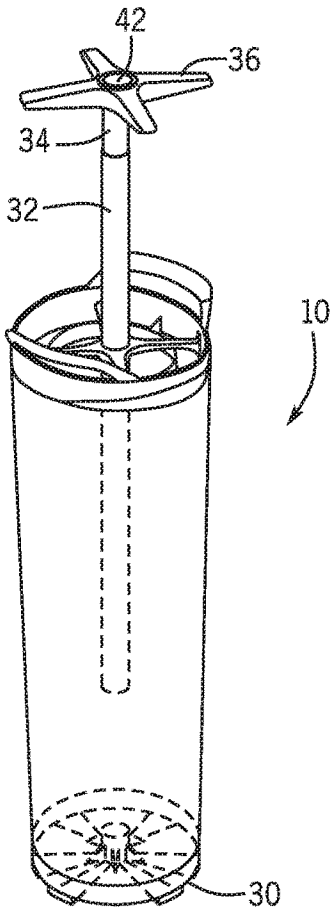
FIG. 11 shows the example golf bag and protector of FIG. 10 with the protector tube partially removed.
Figure 10:
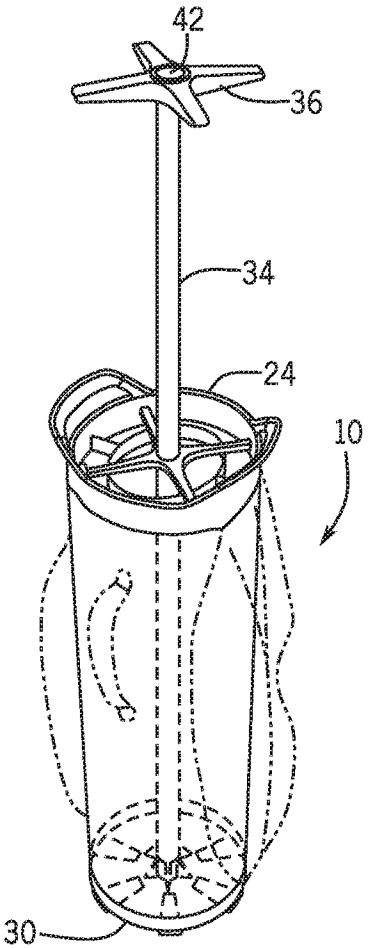
FIG. 10 is a perspective view of the example golf bag and protector in combination with the protector in the extended position
Figure 12:
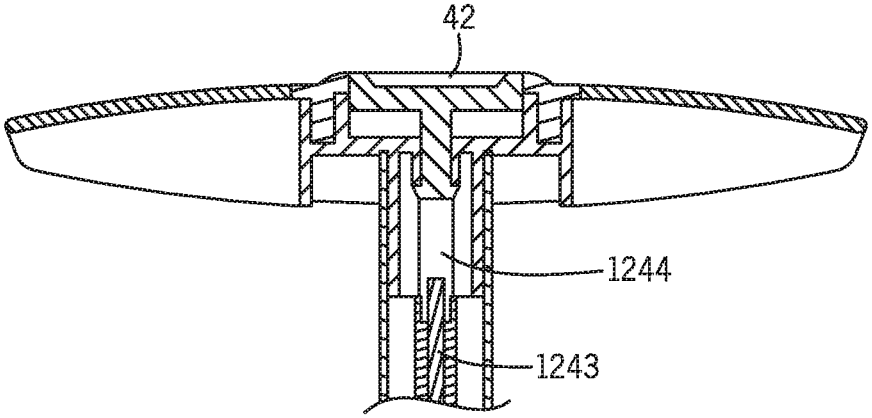
FIG. 12 is a cross sectional of the cap of the protector showing the release mechanism.
Figure 13:
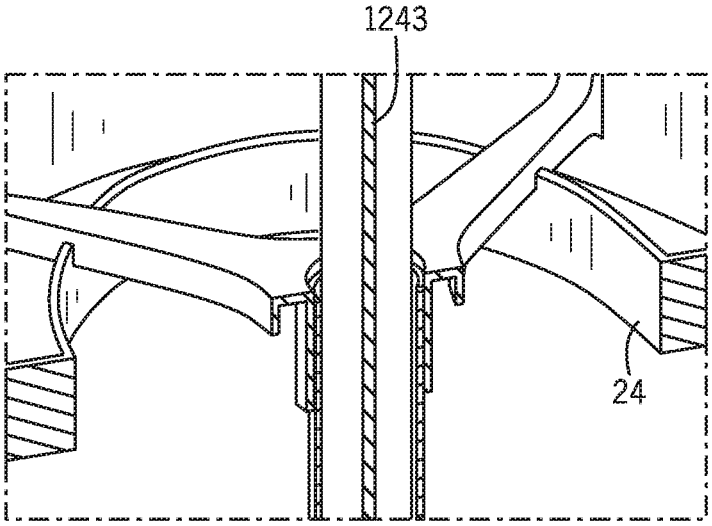
FIG. 13 is a partial cross sectional view the protector tube as coupled to the example collar.

The example protector 20 comprises, in combination, a base 30, the collar 24, and a tube 32 coupling the base 30 to the collar 24. In this example, the tube 32 is a substantially hollow tube extending the entire length between the base 30 and the collar 24. Additionally, as disclosed, the example tube 32 is a rigid tube designed to provide a resistance to any longitudinal compressive force. The tube 32 is configured to accept an extension arm 34, which in this illustration comprises a cap 36 removably coupled to one end of the arm 34. In this example, the arm 34 is slidably coupled to the tube 32, such as for instance as an inner tube and outer tube and may extend between a retracted position (FIGS. 1, 2, and 7) and an extended or protective position (FIGS. 2 and 6). The location of the arm 34 within the tube 32 may be controlled or selected via any suitable position selection mechanism including for instance a locking button selectively coupled to one of a plurality of apertures, a friction coupling, various biasing devices, hydraulics, or any other design as desired.

Figure 1:
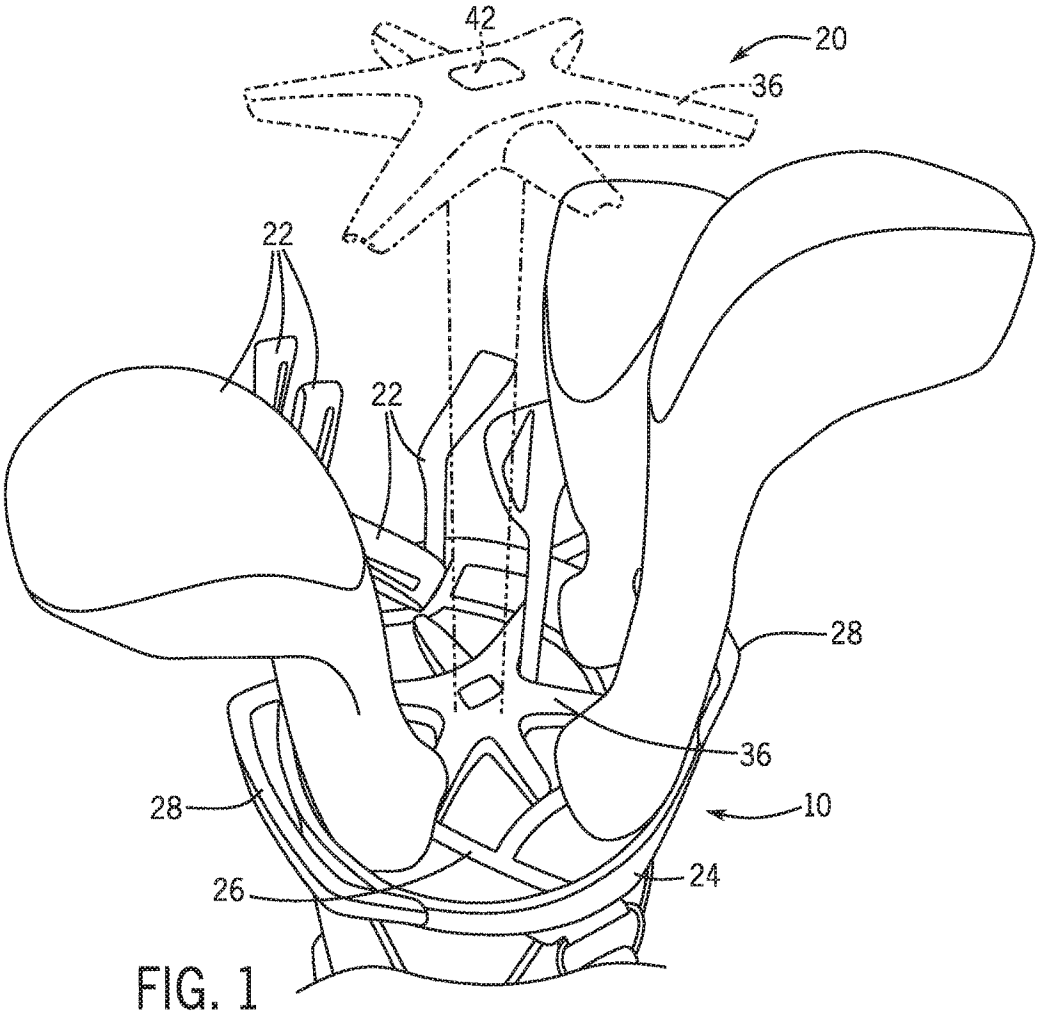
FIG. 1 is a partial perspective view of an example golf bag and protector in combination.
Figure 3:
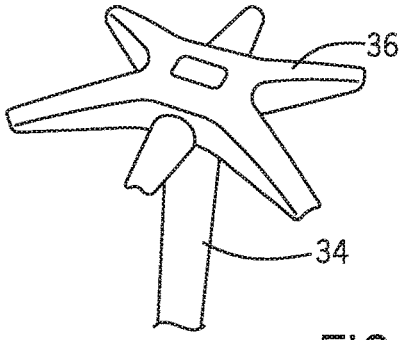
FIG. 3 is an enlarged perspective view of an example cap of the example protector.
Figure 4:
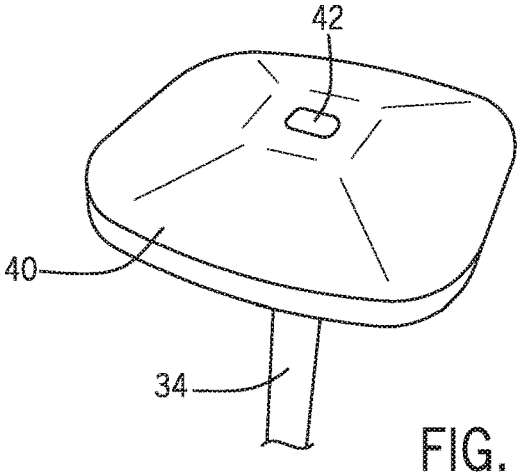
FIG. 4 is an enlarged perspective view of another example cap of the example protector.

As illustrated in FIG. 1, in a retracted position, the cap 36 is configured to nest within or abut substantially flush with the dividers 26. To provide this coupling, the cap 36 may be designed to have a shape, such as a star shape as shown, which corresponds to the layout of the dividers 26. Accordingly, it will be understood that the size and shape of the cap 36 may vary depending upon the design of the collar 24 to which it mates. In this manner, the entire arm 34 and cap 36 assembly may be stored within the bag 10 without having to remove and/or separately store the cap 36 and/or arm 34. Meanwhile, in the extended position illustrated in FIG. 2 and in phantom in FIG. 1, the cap 36 is extended beyond the height which a typical length golf club extends. In the extended position, the cap 36 is capable of providing protection to the golf clubs 22.

Figure 5:
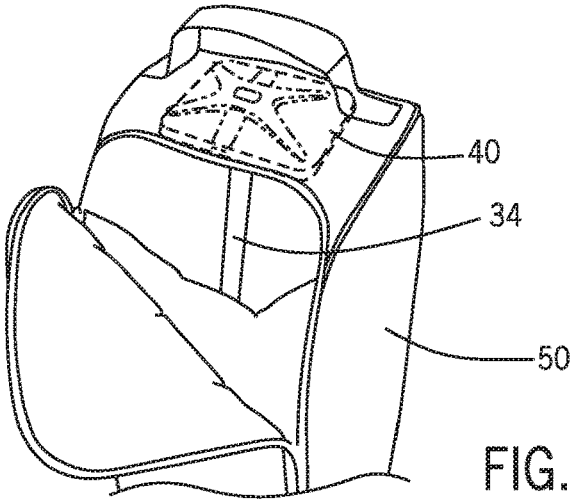
FIG. 5 is a partial perspective view of an example travel case including the example protector.

More specifically, in one example, the cap 36 may be removable in favor of a protective cap 40. In one example, either of the caps 36, 40 may be removed from the arm 34 through a release button 42 or any other suitable mating mechanism as desired. The protective cap 40 may then be utilized within a hood (not shown) attachable to the bag 10 and/or collar 24 or a separate device, such as a travel case 50 as shown in FIG. 5. In at least one example, the protective cap 40 may be integrally provided within the travel case 50. In another example, the protective cap 40 may be separately provided from the travel case 50.

Figure 17:
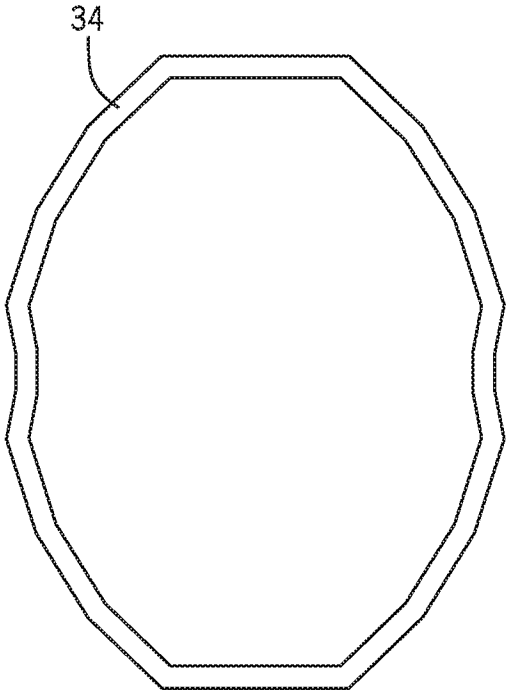
FIG. 17 shows a cross section of the arm.

When the protective cap 40 is integral with the case 50, the protective cap 40 may simply nest with the cap 36, or the protective cap 40 may comprise a coupling mechanism provided to releasably mate with the arm 34 when the cap 36 is removed. Similarly, when the protective cap 40 is separately formed from the case 50, the protective cap 40 may be releasably coupled to the arm 34 or may be nested or otherwise coupled to the cap 36 such that the protective cap 40 abuts the inner surface of the travel case 50 when the golf bag 10 is located within the case 50 and the arm 34 is in the extended position. FIG. 17 shows a cross section of the arm 34.

Figure 14:
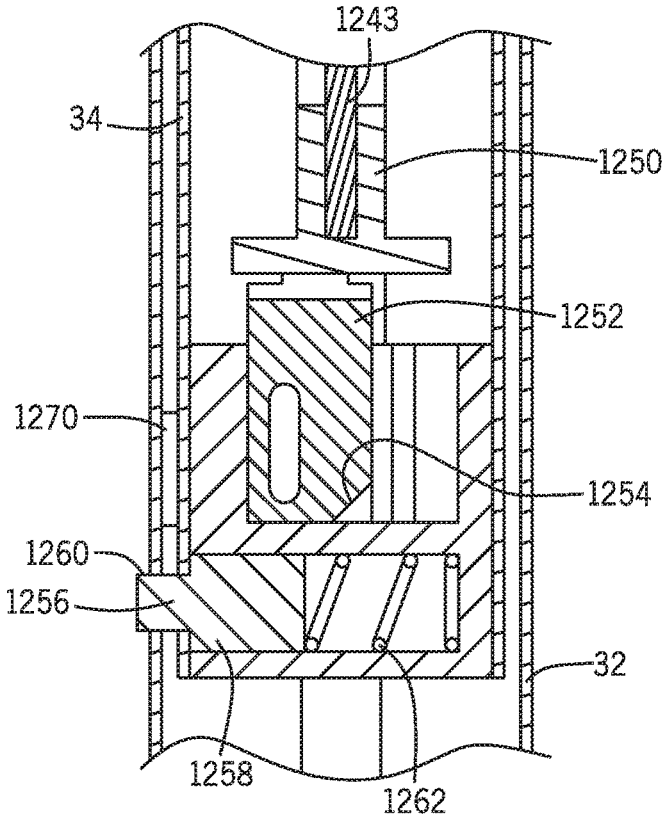
FIG. 14 is a cross-sectional view of one example pin locking mechanism for releasing the tube of the protector to allow the protector to move between the retracted and extended position.

Referring specifically to FIGS. 12-15, one example of the construction and operation of the locking mechanism is illustrated. In particular, as shown the release button 42 is operably connected to a release rod 1243 via a snap hook 1244. The release rod 1243 then extends through the telescoping combination of the arm 34 and the tube 32 to control telescoping operation of the combination. Specifically, as shown in FIG. 14, the release rod 1243 is operably coupled to a release button rod foot 1250. The foot 1250 is operably connected with a wedge 1252. The wedge 1252 contacts a cammed surface 1254 to laterally move (e.g., retract) a pin 1256 when the button 42 is depressed. The pin 1256 is located to extend through an aperture 1258 formed in the arm 34 and when located in the proper orientation, to also extend through an aperture 1260 in the tube 32. A biasing member, such as a spring 1262 operably biases the pin 1256 towards the apertures 1258 and 1260. As will be appreciated, while when the pin 1256 is retracted, the arm 34 and tube 32 are free to move relative to one another, a and when extended through the apertures 1256, 1260, the pin 1256 prevents relative movement between the arm 34 and the tube 32. It will also be appreciated that the tube 32 may include a plurality of apertures disposed along the longitudinal length of the tube 32 to allow for multiple locked positions. A trap ring 1270 may be included to allow for centering of the arm 34 within the tube 32.

Figure 15:
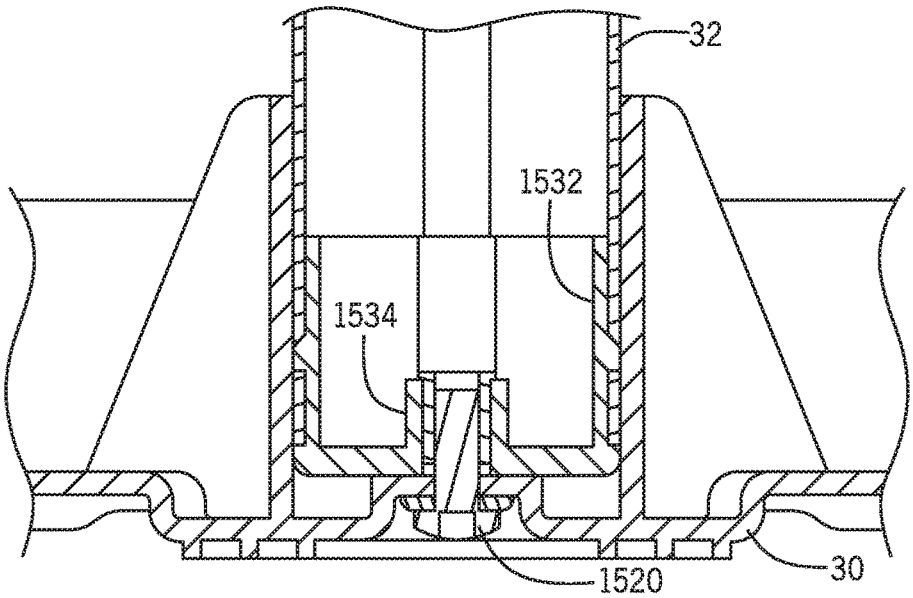
FIG. 15 is a cross sectional view of the pole as retained in the base.

As illustrated in FIG. 15, the tube 32 may be releasably coupled to the base 30 by any suitable device, including, for example, an end cap 1532 and a fastener 1520, such as a screw. More particularly, as illustrated, the tube 32 includes the end cap 1532 mounted to the end of the tube 32, wherein the end cap 1532 includes a threaded aperture 1534. The fastener 1520 may then releasably secure the end cap 1532, and thus the arm 32, to the base 30.

Figure 16B:
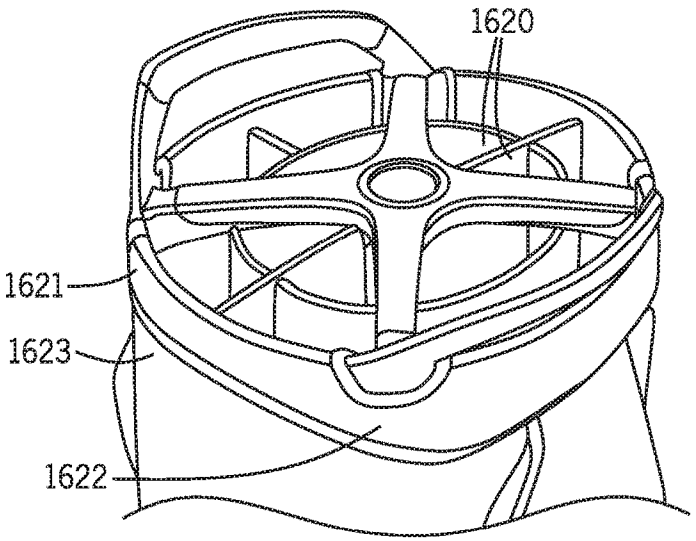
FIG. 16B is a perspective view of the collar.
Figure 16A:
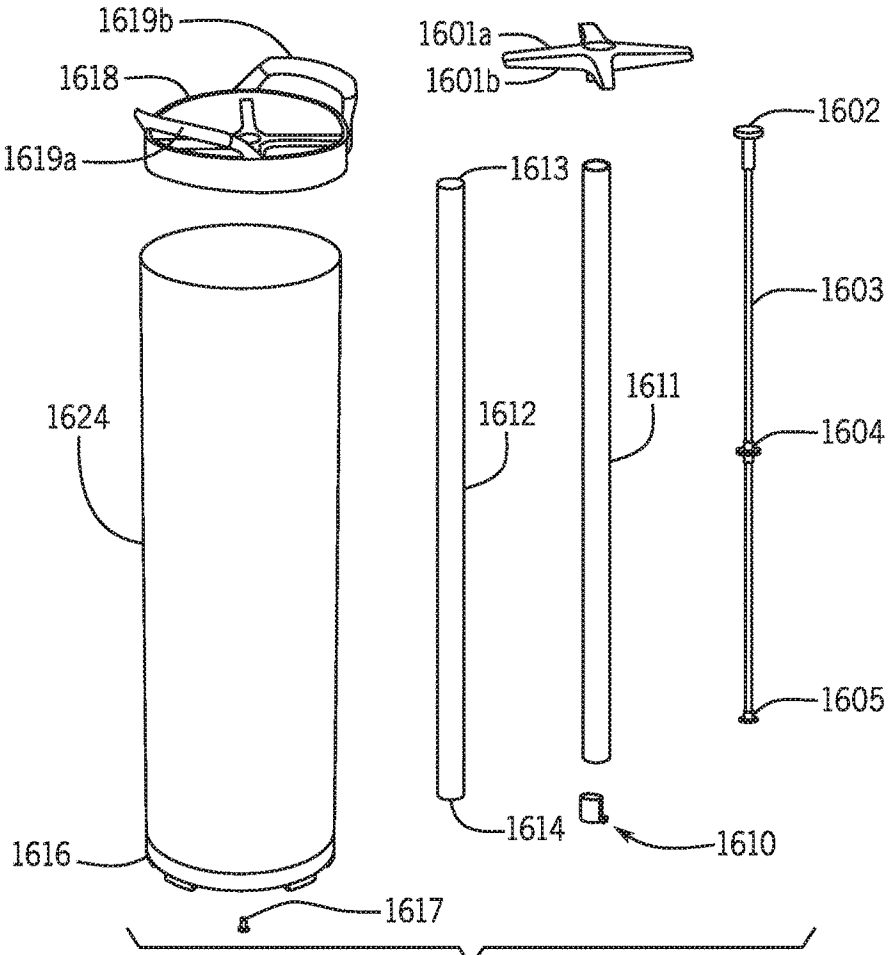
FIG. 16A is an exploded assembly view of the example protector and bag.

FIG. 16A shows an exploded assembly view of another example golf bag and protector. The bag has a top opening into an internal cavity defines by the inner liner 1623. In this example bag, the handle 1601 is made in two co molded parts: an upper part 1601*a* and a lower part 1601*b*. Built into the handle is a lock release button 1602 which is operably connected to a lock release rod 1603 which extends down the length of the central tube 1611, 1612. In the middle portion of the tube, a lock release rod stabilizer 1604 is positioned in order to prevent the rod form flexing. At the end of the rod is lock release foot 1605.

The locking pin mechanism is made of a lock mechanism wedge 1606 in a lock mechanism body housing 1607. In order to prevent a locking pin from being misaligned, a lock mechanism trap ring 1608 is positioned above the slot of the pin in lock release foot 1605. As described above the lock mechanism wedge 1606 biases a lock mechanism spring 1609 connected to a lock mechanism pin 1610 in order to lock the relative movement of the upper tube 1611 with respect to the lower tube 1612. The tube 1612 is closed at either end with a lower tube upper end cap 1613 and a lower tube lower end cap 1614 which is in turn connected via a fastener to the base 1616.

As shown in FIG. 16B is a plastic divider 1618 with over-molded handles 1619*a*, 1619*b* built in to the sides of the divider, which are typically two-part sonic welded together. The arms subdividing the divider include divider walls 1620 and extend to the sides of the bag. The divider is fitted over the top opening of the bag with divider ring outer wrap 1621 extending all around the rim of the opening forming a secure lateral hold on the bag. The divider shown also has a decorative edge finish 1622 with a lower transitional edge bead.

Figure 18B:
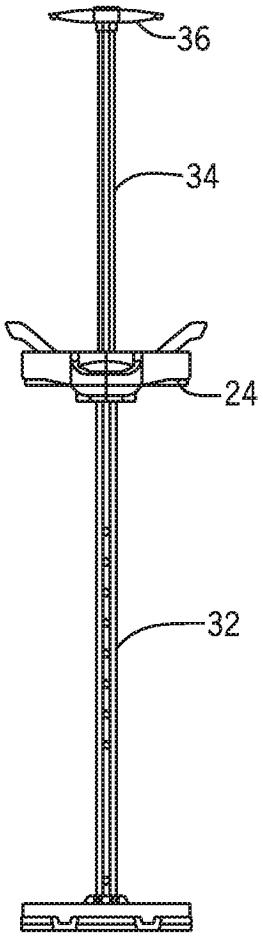
FIG. 18B is a partial perspective view of an example protector in a retracted position.
Figure 18A:
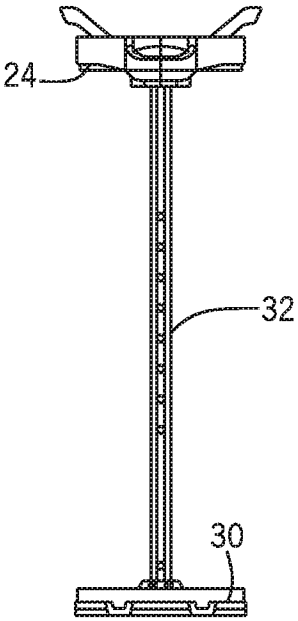
FIG. 18A is a partial perspective view of an example protector in an extended position.

FIG. 18A shows the example protector in an extended position while FIG. 18B shows the protector in a retracted position. In the extended position, the arm 34 topped by handle 36 can be seen extended from the collar 24. In the retracted position, these portions fit fleshly into the divider 26. This allows the arm 34 to fit into the tube 32 anchored by the plate 30.

Figure 19:
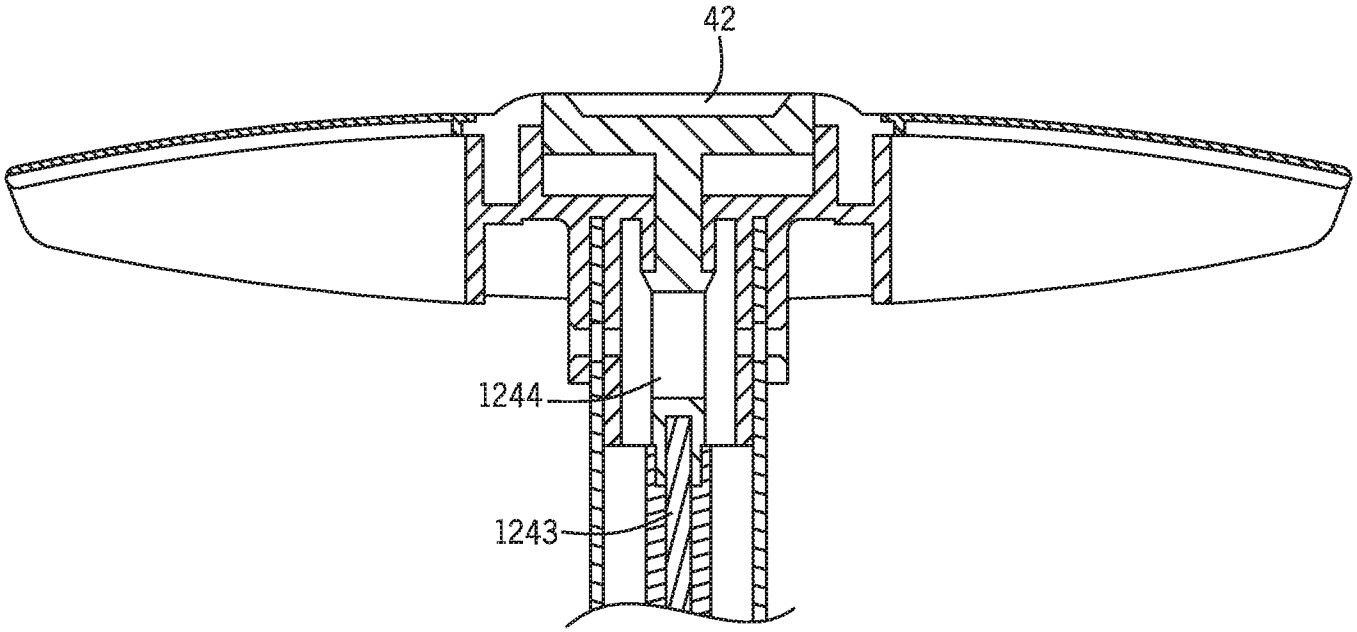
FIG. 19 is a cross section of the handle assembly.
Figure 20:
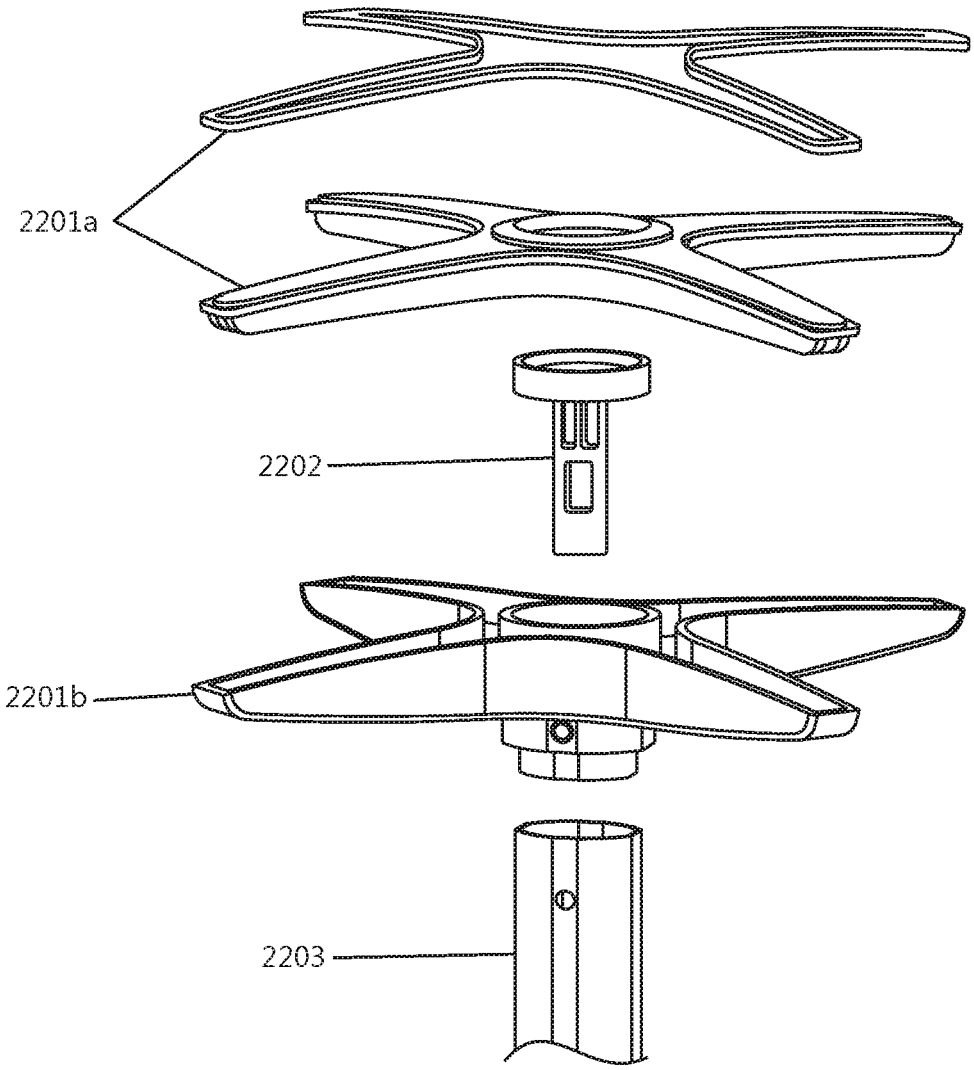
FIG. 20 is an exploded view of the handle assembly.
Figure 21:
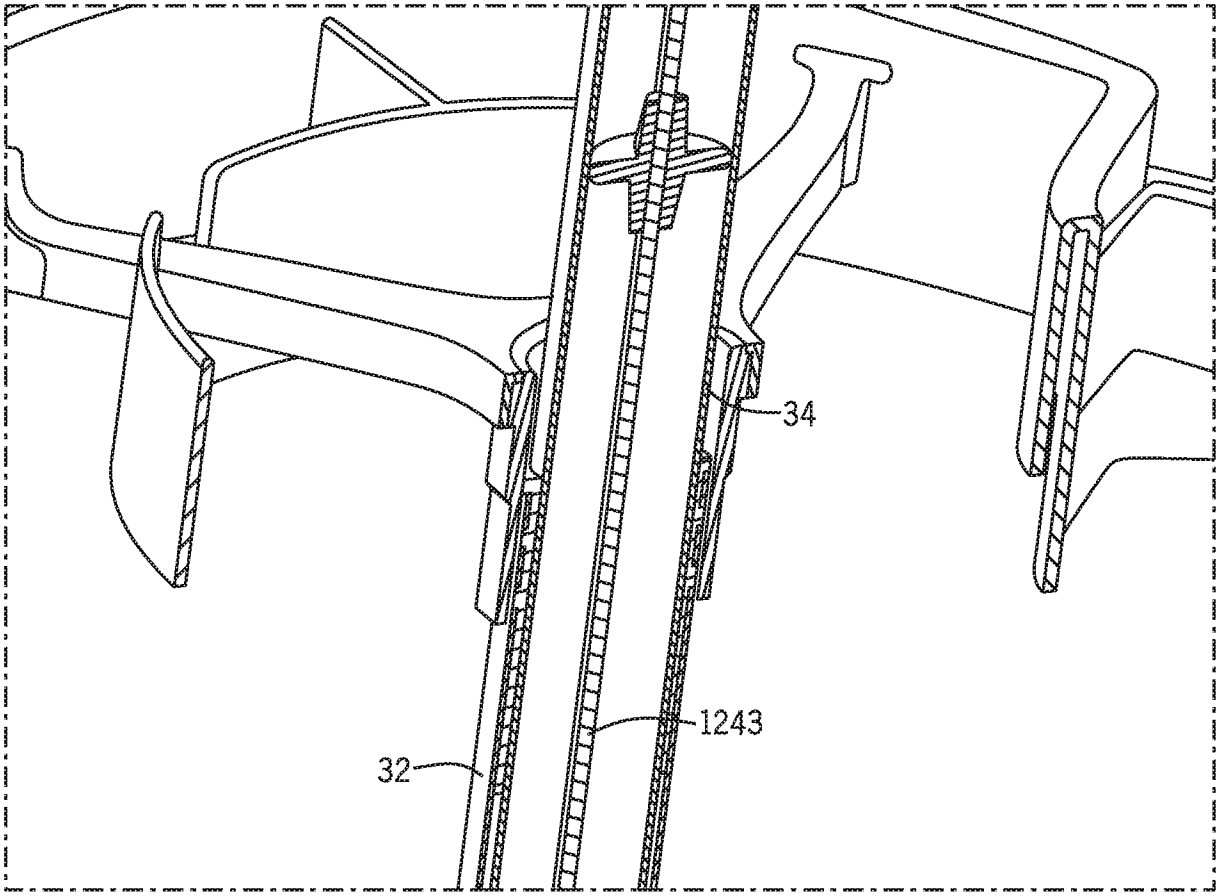
FIG. 21 is perspective partial cross-section of the tube section.

Turning now to FIG. 19, the releasable pin attachment system is shown. This fixes the relative position of the handle 36 and tube 32 which are respectively the inner part and outer part of the extensible member. The release button 42 is connected to the release rod 1243 and fixed by a rivet into snap hook 1244. These components and other parts of the handle assembly are shown in an exploded view in FIG. 20. A cross-sectional view is shown in FIG. 21 showing the handle 32 concentrically in the tube 34 surrounding the release rod 1243 with the central stabilizer shown.

Figure 22A:
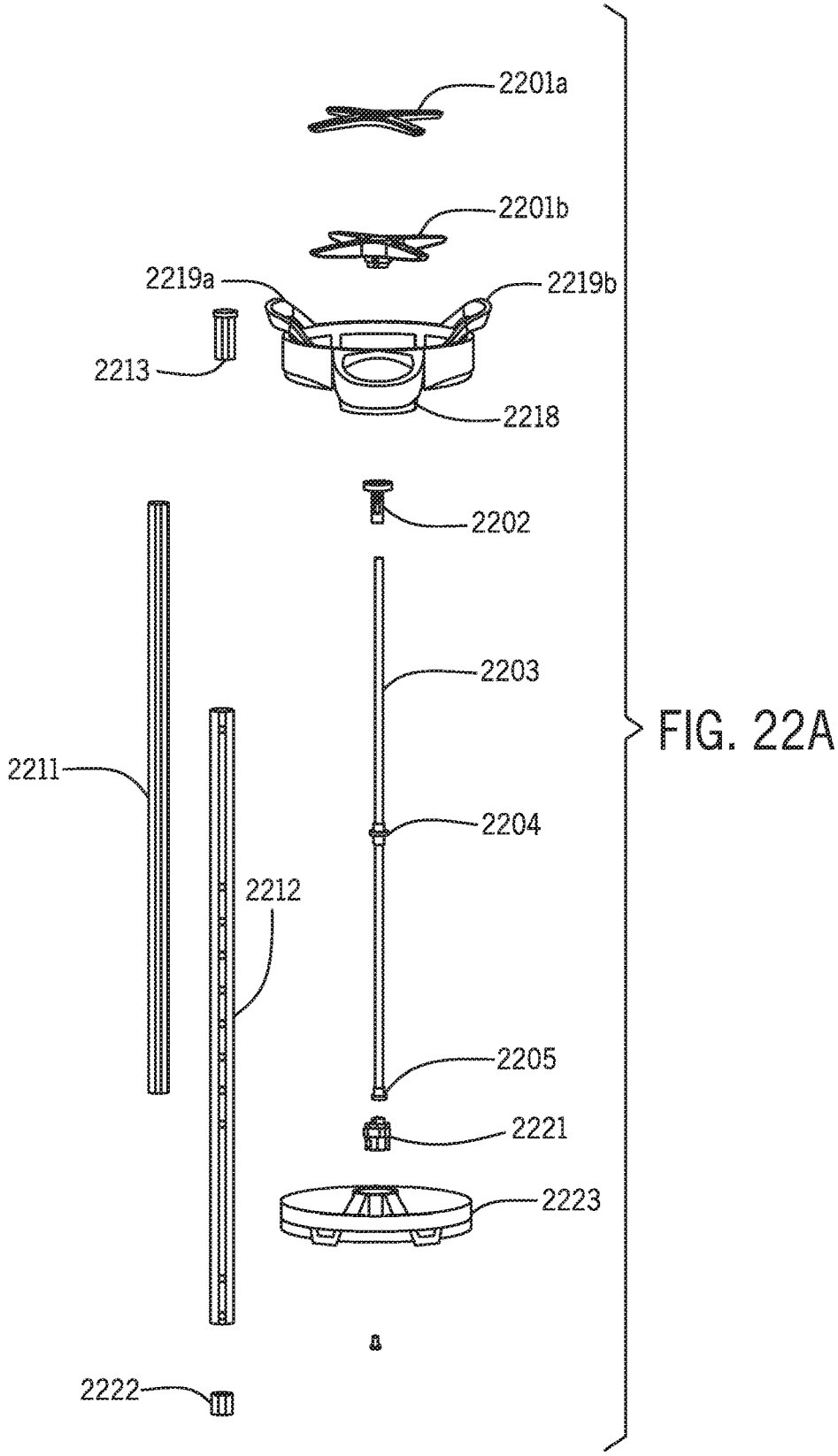
FIG. 22A is an exploded assembly view of the example protector and bag.
Figure 22B:
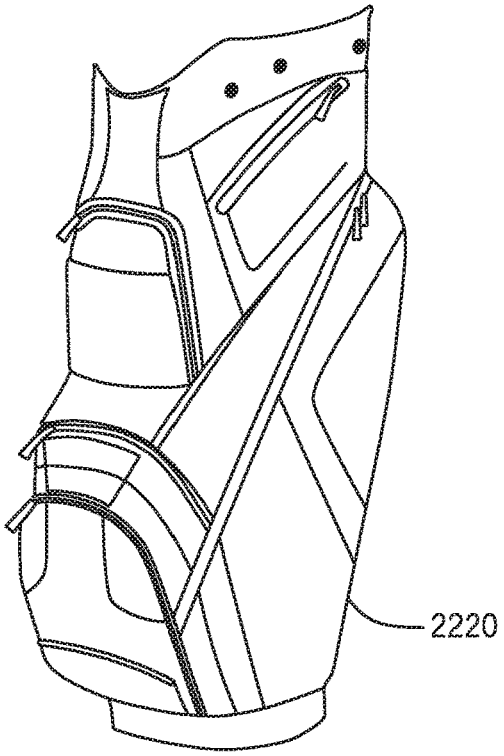
FIG. 22B is a detailed view of an example golf bag.

Another example protector is shown an exploded view of FIG. 22A. In this figure, the protector is shown without a bag. The bag 2220 is shown in FIG. 22B. The "x" shaped handle is shown with both top portion 2201 *a* and bottom portion 2201 *b*. The collar 2218 is co formed with handles 2219 *a*, 2219 *b*. The release button 2202 and stabilizer 2204 are shown on the release rod 2203 with a lower adapter 2205 at the end opposite the release button 2202. The top housing 2213 fits into the handle at the top of the arm 2211 to lock the top of the arm's 2211 and tube's 2212 relative position. The arm 2211 and tube 2212 are fit around the release rod. This assembly connects to locking mechanism 2221 which is itself fixed to the plate 2223.

Figure 22C:
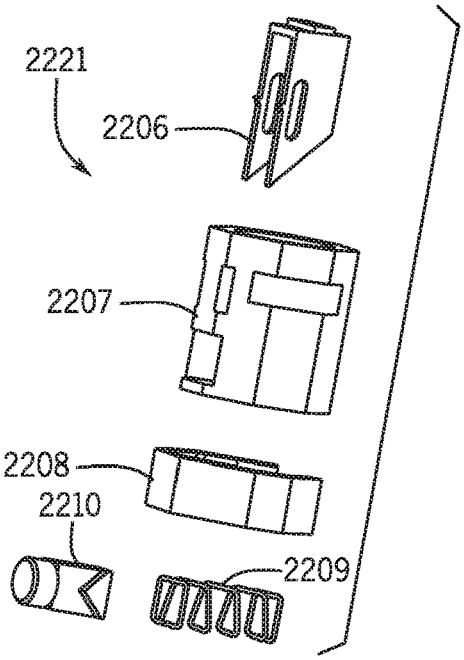
FIG. 22C is a detailed view of the locking mechanism.
Figure 22D:
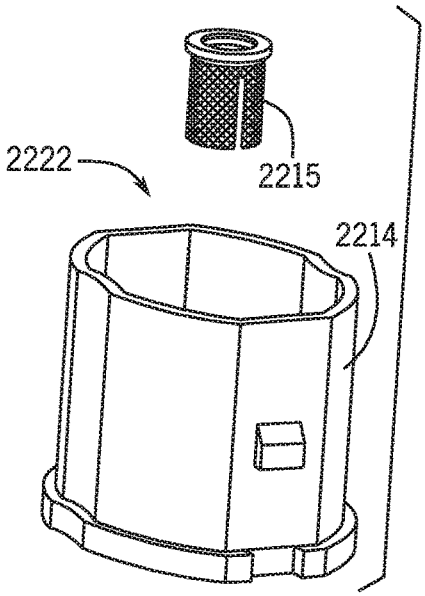
FIG. 22D is a detailed view of the plate's connecting mechanism.

In FIG. 22C, the locking mechanism is shown in an exploded view. As discussed above, the wedge 2206, positioned in mechanism upper housing 2207, biases a lock mechanism spring 2209, contained in mechanism lower housing 2208. The connecting adapter 2214 is built into the plate 2223 is shown in FIG. 22D with a fastener 2215.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A protective golf bag system, comprising:

a golf bag comprising:

a cavity formed by a plurality of side walls and a cavity bottom, wherein the cavity bottom forms a first end of the cavity, an opening formed by the plurality of side walls at a second end of the cavity, and a collar configured to attach to the plurality of side walls that form the opening at the second end of the cavity, wherein the collar comprises a divider that forms a plurality of areas for insertion of one or more golf clubs in the golf bag; and a protector comprising:

a plate affixed to the cavity bottom, a telescoping extensible tube comprising an inner tube configured to telescope within at least a portion of an outer tube, the telescoping extendible tube extending through a center of the divider wherein a bottom of the outer tube is releasably joined to the plate, and a removable protective cover attachable to an end of the inner tube that does not telescope within the outer tube, wherein the telescoping extensible tube is configured to position the removable protective cover at a desired distance over the opening by telescopic movement of the inner tube within the outer tube.

2. The protective golf bag system of claim 1, further comprising:

a travel case configured to hold the golf bag and the protector; and a cap affixed to an inner side of the the travel case, wherein the cap is configured to be coupled to the telescoping extensible tube by at least one of the following: replacing the removable protective cover, or nesting with the removable protective cover.

3. The protective golf bag system of claim 2, wherein the cap is integrally formed with the travel case.

4. The protective golf bag system of claim 2, wherein the removable protective cover comprises two co-molded parts.

5. The protective golf bag system of claim 1, wherein the divider further comprises a plurality of divider arms wherein the plurality of divider arms define the plurality of areas for insertion of the one or more golf clubs.

6. The protective golf bag system of claim 1, further comprising a release system configured to control the telescopic movement of the inner tube inside the outer tube, the release system comprising a connecting member that is moveable between a first position and a second position, wherein:

when the connecting member is in the first position, the release system is configured to prevent relative movement of the inner tube and the outer tube, and when the connecting member in the second position, the release system is configured to allow relative movement of the inner tube and the outer tube.

7. The protective golf bag system of claim 6, wherein the release system further comprises:

a button;

a release button rod operably coupled to the button and configured to be included in the telescoping extendible tube;

a foot operably coupled to the release button rod; and a cammed surface operably coupled to the foot via a wedge, the cammed surface being configured to cause movement of the connecting member between the first position and the second position when the button is depressed.

8. The protective golf bag system of claim 6, wherein the release system comprises a plurality of connecting members each configured to hold the inner tube in a different position with respect to the outer tube.

9. The protective golf bag system of claim 6, wherein the connecting member is a pin.

10. The protective golf bag system of claim 7 wherein the connecting member is biased by a spring.

11. The protective golf bag system of claim 7, further comprising a stabilizer positioned on the release button rod to prevent flexing of the release button rod.

12. The protective golf bag system of claim 1, wherein the removable protective cover configured to have a shape that corresponds to a shape of the divider.

* * * * *